United States Patent [19]

Dorgnon

[11] 3,992,796

[45] Nov. 23, 1976

[54] SYSTEM FOR INTRODUCING AND PLACING CASELESS PELLETS IN A FIRING APPARATUS

[76] Inventor: Roger Dorgnon, Avenue de St. Romains de Lerps, Saint Peray, France

[22] Filed: Nov. 29, 1974

[21] Appl. No.: 528,122

[52] U.S. Cl. ..... 42/90; 221/279; 227/9

[51] Int. Cl.[2] ..... B25C 1/18

[58] Field of Search ..... 221/279, 307, 310; 227/9, 10, 11, 120; 42/87, 88, 90; 86/38, 45, 46; 89/27 B

[56] References Cited

UNITED STATES PATENTS

| | | | |
|---|---|---|---|
| 496,143 | 4/1893 | Velten et al. | 86/38 |
| 2,542,842 | 2/1951 | Saunders | 86/46 |
| 3,240,103 | 3/1966 | Lamont | 86/45 |
| 3,292,293 | 12/1966 | Chiasera et al. | 42/87 |
| 3,659,768 | 6/1970 | Brunelle | 227/10 |

*Primary Examiner*—Stephen C. Bentley
*Attorney, Agent, or Firm*—Donald R. Motsko; H. Samuel Kieser; William W. Jones

[57] ABSTRACT

A system for introducing caseless propellant pellets into a firing chamber of an apparatus deriving power from such pellets. The system includes a guide for holding a supply of pellets in a refillable container, and a pusher acting on the pellets to selectively deliver one thereof to the firing chamber.

2 Claims, 6 Drawing Figures

SYSTEM FOR INTRODUCING AND PLACING CASELESS PELLETS IN A FIRING APPARATUS

The invention relates to a system for introducing and placing caseless propellant pellets in a firing apparatus such as a firearm or a fastening tool.

Firing apparatus such as powder-actuated fastening tools operated by an agglomerated powder charge in the form of a pellet have undergone considerable developments in the last few years. Due to their small size, inflammability and friability, the pellets must be protected up until the time of use. Moreover, for the same reasons it is desirable to have means for guiding, introducing and placing the pellets in the chamber of the tool.

The hitherto available apparatus only partly fulfill the first function and use means which do not provide the desired reliability in connection with the second function.

To this end, the invention has for its object a system for introducing and placing caseless propellant pellets in a fastening tool, characterized in that it comprises a support which can receive an elongated refill container which itself contains a plurality of aligned and adjacent pellets, a pusher acting on the final pellet in a line of pellets and means for positioning the end of the said support opposite to the said pusher adjacent an opening in the chamber for inserting the pellets in the tool.

The system according to the invention therefore permits the preservation of the pellet and has means for bringing them to the chamber of the tool, whilst avoiding any direct manipulation of the pellet.

Preferably the elongated refill container comprises a member with a flattened U-shaped cross-section with turned down edges, whereof at least one side has at one end at least one inwardly directed lug and the pellets are aligned edge to edge within the said member. The lugs serve to prevent the accidental discharge of the pellets without impeding the action of the pusher. It is desirable that the lug should be at a distance from the adjacent end of the member which is less than half the diameter of a pellet along the axis of the member in such a way that the pellet is expelled from the end after it passes the lug.

According to a particularly advantageous embodiment, the pusher is moved manually and its movement is indexed in stepwise manner, whereby, the movement step is equal to the size of a pellet along the longitudinal axis of the said refill container. In this case, according to one construction the support is provided with a plurality of aligned slots or indentations which are spaced relative to one another and the pusher has a ball associated with it which is re-set by a spring and which cooperates with the slots. Therefore, while maintaining the support fixed, the operation of the pusher permits the extraction of the pellets one by one.

According to the invention, the receiving chamber of the fastening tool is cone-shaped and the average diameter is substantially equal to the largest dimension of a pellet and is open at its smallest diameter portion, whereby the said opening is made laterally over the complete height of the said chamber. The driving pellet is therefore introduced with a small amount of force and maintained in the chamber.

In addition, a shoulder is provided in that part of the tool which carries the chamber, whereby the said shoulder cooperates with a corresponding shoulder at the end of the said support. The cooperation of the shoulders ensures a precise positioning of the support relative to the chamber.

According to a particularly simple embodiment wherein the loading apparatus is not incorporated in the tool, the end of the support which cooperates with the chamber has two parallel arms in a plane which does not include the said shoulder, whereby each of the said arms cooperates with a groove made in the said portion of the tool which carries the chamber.

In an embodiment with incorporated loading, the support is slidingly mounted in the tool whereby a return spring serves to move it away from the chamber. In this case the pusher is integral with a grip which projects outside the tool through a gap made in the latter.

The invention will be better understood by reference to the following description and to the accompanying drawings in which.

Figure 1:
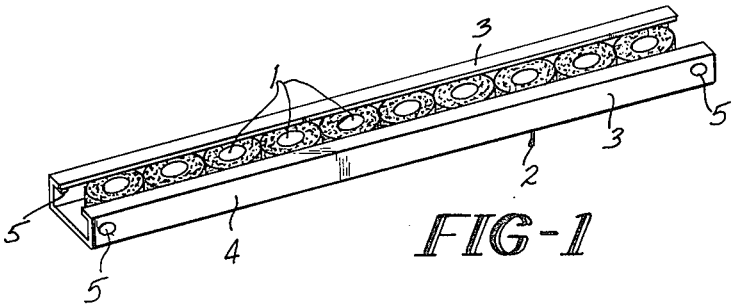
FIG. 1 is a perspective view of a pellet refill container.

As shown in FIG. 1, the caseless propellant pellets 1 are enclosed in a member 2 having a flattened U-shaped cross-section with bent down edges 3. The sides 4 of the member have at each end a lug 5 which prevents the accidental discharge of the pellets 1. The lugs are located at a distance from the adjacent end of member 2 which is less than the radius of a pellet 1 in such a way as to ensure the discharge of a pellet which has already passed the lug.

Figure 2:
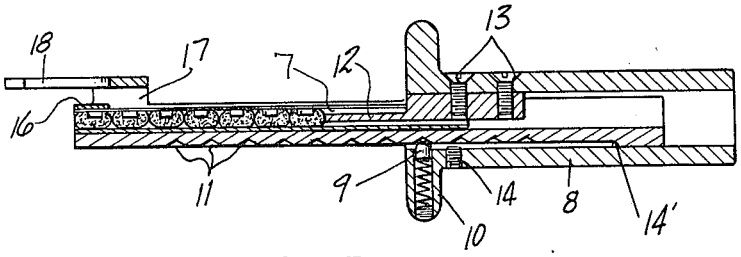
FIG. 2 is a cross section of a loading apparatus according to one embodiment of the invention.
Figure 3:
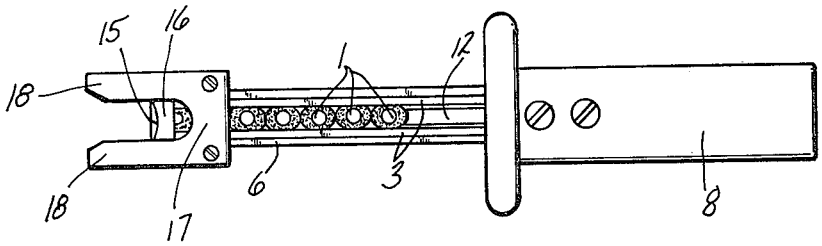
FIG. 3 is a plan view of the apparatus of FIG. 2.
Figure 4:
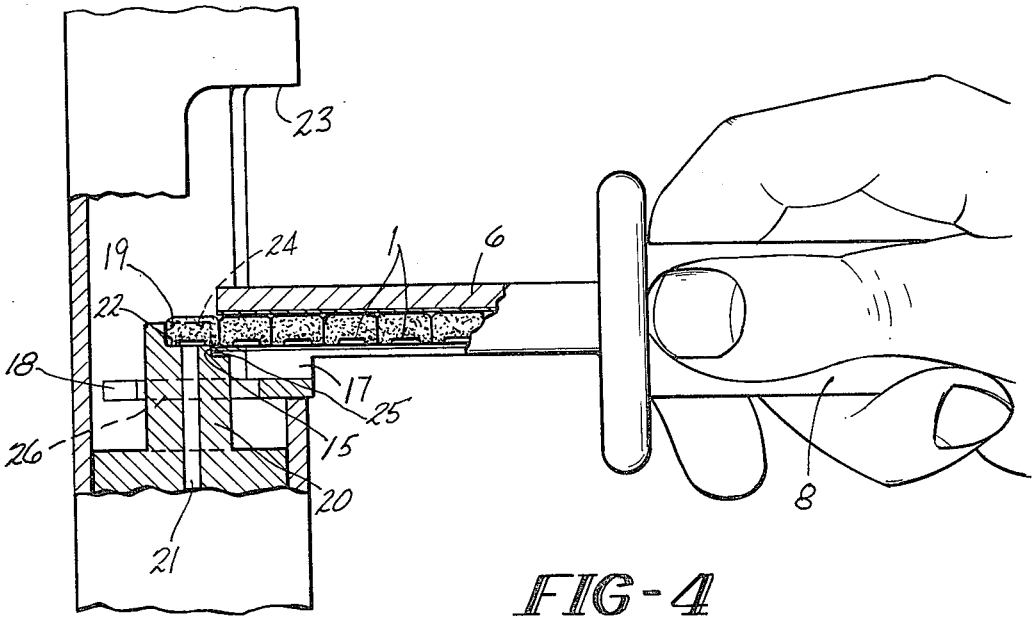
FIG. 4 is an elevation partly in cross-section of the apparatus of FIGS. 2 and 3 in use with a fastening tool.

FIGS. 2–4 show an embodiment of an apparatus for inserting the pellets 1, wherein the said apparatus is not incorporated into a fastening tool or other firing apparatus. The member 2 is located in a support 6 which has a U-shaped recess 7 whose length is greater than that of member 2. A hollow handle 8 can slide relative to support 6 and has a ball 9 which is urged by a spring 10 against the aligned and equi-distant slots 11 formed on the outer surface of support 6 opposite to recess 7. The spacing between the two adjacent slots 11 is equal to the diameter of the pellets 1.

A pusher member 12 is fixed inside the handle 8 by screws 13 in such a way as to be able to slide longitudinally in recess 7 and within member 2 when fitted. A stop screw 14 fixed in handle 8 orientates the latter relative to support 6 on the one hand, and on the other limits the movement of handle 8 relative to support 6. Support screw 14 is adapted to engage a shoulder 14' on support 6. At its other end recess 7 is terminated by a rounded shoulder 15 formed in a member 16 which covers the upper edge of the end of the recess.

A fork 17 having two arms 18 is fixed to the end of support 6 adjacent to member 16, whereby the arms 18 are located in a projecting plane relative to recess 7 on the same side as member 16.

Referring to FIG. 4, the chamber 19 for the pellets is made in a cylindrical area 20 of the bolt of the fastening tool, whereby a bore 21 extends into the base 22 of the chamber to permit the passage of the firing pin (not shown). The breach (not shown) has a complementary shape in such a way that it seals the chamber 19. Chamber 19 is cone-shaped, whereby base 22 has the larger diameter. An opening 23 is made in the tool to permit introduction of the pellets. Facing opening 23 is an opening 24 in the wall of the chamber 19, whereby the width of opening 24 is substantially equal to the diameter of a pellet 1. A shoulder 25 is formed in the area 20 at the base of opening 24 and two grooves 26 are provided on either side of this area 20.

In order to introduce the refill container formed by member 2 containing pellets 1 into the apparatus, the handle 8 is moved towards the rear until the stop screw 14 abuts against shoulder 14' of support 6. Member 2 can then be introduced into recess 7, whereby the open face of the member 2 is turned towards the opening of recess 7. Handle 8 is then brought into the position where ball 9 cooperates with the first slot 11 and pusher 12 engages the final adjacent pellet in member 2. The loading apparatus is then ready for use.

With the opening 23 of the tool unobstructed, the end of the apparatus is introduced thereinto until the rounded shoulder 15 of member 16 strikes against shoulder 24 of the bolt, whereby each arm 18 cooperates with one of the grooves 26. The loading apparatus is then accurately positioned relative to the bolt with the recess 7 being located in alignment with the opening 24 of the chamber 19. If the operator holds the apparatus by handle 8 (FIG. 4) moves the latter axially, support 6 advances by one step until ball 9 cooperates with the following slot 11. During this movement the first pellet 1 moves out of member 2 and is pushed by the following pellet into chamber 19 through opening 24. Due to the inverted cone shape of chamber 19 the pellet is kept locked therein. By pulling on handle 8 the operator extracts the loading apparatus whereby handle 8 and support 6 remain in the same relative position. After closing the tool and introducing a fastener the tool is ready for use. The loading apparatus is also ready for use again with the pusher member 12 in engagement against the final pellet.

Figure 5:
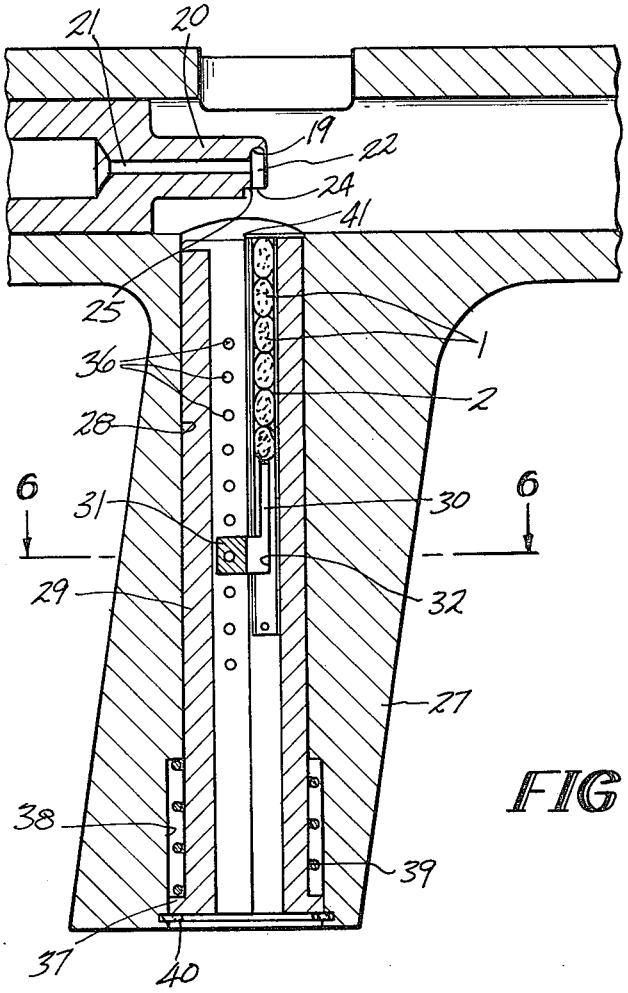
FIG. 5 is a cross section of part of a fastening tool equipped with a loading apparatus according to another embodiment of the invention.
Figure 6:
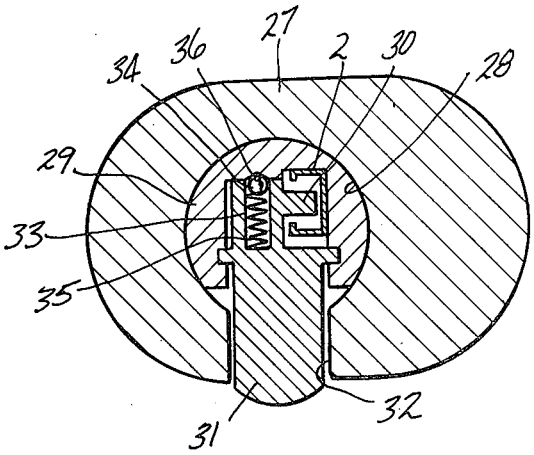
FIG. 6 is a sectional view taken along the line VI-VI of FIG. 5.

Reference should now be made to FIGS. 5 and 6 which show a variant of the system according to the invention wherein the loading means is incorporated in the tool. The bolt is identical to that of the previous embodiment but is not provided with grooves 26.

A longitudinal bore 28, which is substantially perpendicular to the bolt 20 and in which slides a support 29, is provided in the grip 27 of the tool. A longitudinal recess in the support 29 receives the member 2 containing the pellets 1. In support 29 slides a pusher member 30 which is integral with a handle 31 which projects outside grip 27 through a slot 32. In bore 33 of the pusher member 30 is a ball 34 urged by a spring 35 to cooperate with aligned and equi-distant slots or indentations 36 provided in support 29.

The end of support 29 which is positioned towards the bottom of grip 27 includes a flange 37 which can slide in an inner counterbore 38 in the end of the bore 28. A spring 39 is interposed between the flange 37 and the bottom of the counterbore 38. A retaining ring 40 serves to maintain the support 29 in the bore 28.

At its end opposite to flange 37 support 29 has a shoulder 41 which cooperates with the shoulder 25 of striker holder 20.

The apparatus described hereinbefore is extremely simple and convenient to use. With support 29 being already fitted with member 2 in the manner shown (it can be seen that several pellets have already been used), upward movement of the pusher handle 31 brings about the initial simultaneous advance of support 29 with member 2 and pusher member 30 against spring 39. In actual fact pusher 30 and support 29 remain integral due to the ratchet mechanism resulting from the cooperation of ball 34 with a slot 36, the friction force of which exceeds the return force of spring 39. As soon as shoulder 41 strikes against shoulder 25 of striker holder 20 support 29 is locked and pusher 30 moves by one step until ball 34 faces the following slot 36. During this time, as in the previous case, the pellet at the open end has been introduced into the chamber 19 and is held locked therein. As soon as the operator releases handle 31, spring 39 draws back support 29 to engage with retaining ring 40 and the pusher member 30 is subjected to the same return movement due to the cooperation of ball 34 with the new slot 36.

What is claimed is:

1. In a device for introducing, one at a time, propellant pellets into a firing apparatus from a prepackaged container holding a plurality of aligned pellets; a support member for receiving the pellet container; a handle member having a bore in which said support member is telescopingly disposed, said handle member being slidable over said support member so as to position a greater or lesser portion of said support member within said bore; a pusher fixed to said handle member and positioned so as to extend forward of said handle member within a projection of said bore to engage a terminal one of the pellets; and indexing means on said handle member and said support member to signal an amount of movement of said handle member over said support member approximately equal in length to the diameter of one of the pellets.

2. The device of claim 1 further comprising aligning means extending axially from said support member for engagement with a pellet-receiving portion of the firing apparatus to ensure proper alignment of the device when dispensing a pellet therefrom.

* * * * *